US005563549A

United States Patent [19]

Shieh

[11] Patent Number: 5,563,549

[45] Date of Patent: Oct. 8, 1996

[54] LOW POWER TRIM CIRCUIT AND METHOD

[75] Inventor: Sui P. Shieh, Los Altos, Calif.

[73] Assignee: Maxim Integrated Products, Inc., Sunnyvale, Calif.

[21] Appl. No.: 407,101

[22] Filed: Mar. 17, 1995

[51] Int. Cl.[6] ..... G05F 1/10; G05F 3/02

[52] U.S. Cl. ..... 327/543; 327/541; 327/546; 323/315

[58] Field of Search ..... 327/538, 540, 327/541, 543, 545, 546, 437, 78, 77, 334; 323/315

[56] References Cited

U.S. PATENT DOCUMENTS

| | | | |
|---|---|---|---|
| 4,520,282 | 5/1985 | Watanabe et al. | 327/538 |
| 4,897,560 | 1/1990 | Saito et al. | 327/540 |
| 4,978,905 | 12/1990 | Hoff et al. | 323/315 |
| 4,994,730 | 2/1991 | Rossi et al. | 323/315 |
| 5,353,028 | 10/1994 | de Wit et al. | 323/315 |
| 5,384,740 | 1/1995 | Etoh et al. | 327/540 |
| 5,391,979 | 2/1995 | Kajimoto et al. | 327/543 |

*Primary Examiner*—Timothy P. Callahan
*Assistant Examiner*—My-Trang Nu Ton
*Attorney, Agent, or Firm*—Hickman Beyer & Weaver

[57] ABSTRACT

A lower power trim circuit in accordance with the present invention includes the series connection of a resistive element, a first transistor, and a second transistor between nodes of a voltage source. The first transistor (which is coupled to the resistive element) is much larger, e.g. twice as large, as the second transistor. When the resistive element is in a low resistance state, the first transistor dominates a node between the first and second transistors due to its large size, thereby causing the node attain a first logical state. When the resistive element is in a high resistance state, the second transistor dominates the node, causing the node to go to a second logical state. The programmable resistive element is preferably selected from a group consisting essentially of silicide resistors, capacitors, and antifuses. The low power trim circuit of the present invention consumes very little power because the gain of the transistor coupled to the resistive element is used to achieve the desired rail-to-rail swing of the output. A low power trim system of the present invention includes one or more of the aforementioned trim circuits and, in addition, a power supply, a bias generator, and a resistive network. A method for trimming a circuit includes measuring at least one resistive parameter of a resistive network in an integrated circuit, comparing the resistive parameter to a desired resistive parameter, determining a trim resistor programming pattern, and programming at least one trim resistor in the integrated circuit in accordance with the trim resistor programming pattern such that flowing a current through a series connection of the trim resistor in an unbalanced transistor pair of the integrated circuit develops a trim signal at a juncture between said unbalanced transistor pair.

25 Claims, 3 Drawing Sheets

LOW POWER TRIM CIRCUIT AND METHOD

BACKGROUND OF THE INVENTION

This invention relates generally to analog integrated circuits, and more particularly to circuits and methods for trimming networks, such as resistive networks, of analog integrated circuits.

Networks (including resistive, capacitive, inductive, and current source networks) are commonly used in analog integrated circuits. For example, resistive networks are commonly used to provide desired reference voltage levels. A resistive network can simply include the series connection of a number of resistive elements between the nodes of a voltage source, or may be a more complex structure including switches, gates, etc. Typically, the voltage source provides a known voltage output $V_{cc}$ of five or three volts dc with respect to ground. The topmost node of the resistive network is therefore typically at about $V_{cc}$, and the bottom most node of the resistive network is typically at about ground. Intermediate nodes of the resistive network, i.e. nodes between the various resistive elements, will have a voltage level somewhere between ground and $V_{cc}$. Therefore, a resistive network of a prior art serves as a voltage divider to provide a number of reference voltage levels.

The resistive elements of a resistive network are formed on an integrated circuit and, therefore, are subject to process variations inherent in all integrated circuit manufacture. For example, with a typical process, the resistance of a given resistive element may have a tolerance of only about ±5% with respect to a desired resistance. This level of accuracy is inadequate for many applications, where it is desired to have a much smaller tolerance level, e.g. ±1% tolerance for the resistive elements.

To obtain the desired tolerance, it has been known in the prior art to provide "trim" circuits to vary resistive parameters of the resistive network. By trimming, it is possible to provide a resistive network with the desired degree of tolerance in its resistive elements, resulting in reference voltages with a corresponding desired degree of tolerance.

In FIG. 1, a prior art trim system 10 includes a trim circuit 12 and a resistive network 14. The trim circuit 12 includes a current source 16, a transistor 18 that forms one half of a current mirror, and two trimmers 20 and 22. The current source 16 is of conventional design and is typically capable of providing approximately 10 microamperes (μA) of current. The transistor 18 is, in this example, a n-channel MOSFET having its drain coupled to the output of current source 16 and having its source coupled to ground. A conductor 24 is coupled between the drain and gate of MOSFET 18 to form one half of a current mirror.

Each of the trimmers 20 and 22 include the series connection of a resistive element 26 and a transistor 28. In this example, the resistive element 26 is a oxide-silicide-oxide sandwich having one node coupled to $V_{cc}$ and having another node coupled to the drain of transistor 28. In this example, transistor 28 is an n-channel MOSFET transistor. The sources of both transistors 28 are coupled to ground, and the gates of transistors 28 are coupled to the gate of MOSFET 18. Therefore, as will appreciated by those skilled in the art, MOSFET 18 forms a current mirror with each of the MOSFETS 28 to provide a substantially constant reference voltage on a conductor 30 coupled to the gates of both transistors 28. A trim signal from trimmer 20 is developed between the resistive element 26 and the MOSFET 28 at a node A. A trim signal from trimmer 22 is developed between resistive element 26 and MOSFET 28 of the trimmer 22 at a node B.

The resistive network 14 includes a decoder 32 and a network 34 comprised of the series connection of a number of switch/resistor pairs 36. Each of the switch/resistor pairs 36 includes an electronic switch 38 (such as a transistor) and a resistor 40. In this instance, the decoder 32 is a 2::4 decoder which takes a signal on the two input lines 42 and decodes it into the four output lines 44. The construction of 2::4 decoders is well known to those skilled in the art. This permits the two trim signals at nodes A and B to open or close selected switches 38. The closure of a switch 38 shorts the associated resistor 40, thereby changing a resistive parameter of the network 34. As used herein "resistive parameter" or "parameter" of a resistive network means a measurable resistance between any two nodes of a network, such as network 34. This resistive parameter may be between the top and bottom of the network 34, across any one of the resistors 40, or across any series combination of resistors 40.

The trim system 10 operates as follows. An integrated circuit is manufactured having the resistive network 14 and the trim circuit 12. An ohmmeter 46 is coupled across various nodes 47 of the network 34 to measure resistive parameters. The measured resistance is then compared to a desired resistance and, if the network 34 is within tolerance specifications, the process is complete. If the measured resistance is not within the desired tolerance, a table or algorithm is consulted to determine a programming pattern for the resistive elements 26. Depending on the desired "trim", either, neither, or both of resistive elements 26 can be programmed. By "programmed" it is meant that a process of some type is performed to change the resistance of the resistive elements 26 in a discernible matter, i.e. changing the resistance by at least a couple orders of magnitude. This programming causes the trim circuit 12 to create a trim signal which controls, after being decoded by decoder 32, the switches 38 of the resistive network 14. Measurements can then be taken again with ohmmeter 46 and additional trimming can be performed, if desired or required.

There are a number of types of programmable resistive elements available in the prior art. For example, in FIG. 2*a*, a resistor 48 is fabricated over a semiconductor wafer substrate (not shown) and includes a base oxide layer 50, a silicide layer 52, and a top oxide layer 54. The layers 50, 52, and 54 therefore define a "sandwich" structure which is typically rectangular in configuration having a length l and a width w. The ratio of l:w is typically 15:1 to 20:1, where the width w is often in the range of 1–2 microns. The oxide layers 50 and 54 are typically silicon dioxide ($SiO_2$), and the silicide layer 52 can be chromium silicon (CrSi). The construction of such resistive elements are well known to those skilled in the art.

The resistor 48 can be programmed with a laser beam 56. Before programming, the measured resistance between the two ends e of the resistor 48 is in the order of 1–2 kilohms. After being programmed by laser beam 56, the measured resistance between the two ends e is at least 1 megaohm. It should be noted that the laser beam 56 does not vaporize all or even a majority of the material at its point of contact but, rather, causes a recrystalization and scattering of atoms which programs the resistor 48 into a high resistance state.

In FIG. 2*b*, an integrated circuit capacitor 58 can also be used as a programmable resistive element. The capacitor/resistive element 58 (seen here in cross-section) typically includes a lower layer of polysilicon 60, a middle layer of silicon dioxide 62, and a top layer of polysilicon 64. Since the two polysilicon layers 60 and 64 (which are conductors) are separated by the dielectric oxide layer 62, a capacitor is formed. The resistance measured between the top t and the bottom b of the capacitor/resistive element 58 is very high in an unprogrammed state due to the oxide layer. However, when "programmed" by means of a laser beam or a high voltage applied between conductive layers 60 and 64, conductive paths are formed through the oxide layer between the polysilicon layers 60 and 64. In the unprogrammed state, the capacitor/resistive element 58 has a resistance in the order of 10 megaohms (MΩ), and after programming the capacitor/resistive element 58 can have a resistance in the range of 10 kilohms (KΩ).

In FIG. 2*c*, another prior art programmable resistive element is shown in cross section. An antifuse type resistive element structure 66 includes a bottom conductive layer 68, an oxide layer 70 provided with a via hole 72, and an upper conductive layer 74. The via hole 72 is filled with an antifuse material 76 such as amorphous silicon. The conductive layers are typically aluminum or aluminum alloy with a barrier coating of titanium tungsten (TiW) to prevent aluminum contamination of the amorphous silicon. When in an unprogrammed state, the resistance measured between the top t and bottom b of the antifuse structure is in the order of many megaohms. After programming the antifuse material 76 by creating a large voltage potential (e.g. 20+ volts d.c.) between layers 74 and 68, conductive pathways are formed through the antifuse material 76 lowering the resistance of the antifuse structure to the range of 100–200 ohms.

As noted above, there are variety of resistive elements that are known in the prior art to be suitable for use in integrated circuits. A common characteristic of the described programmable resistive element is that their resistance does not vary between zero and infinite resistance but, rather, vary between a small resistance and a large resistance. While traditional metal fuses, typically fabricated from aluminum in a "bow-tie" configuration, can be programmed to vary in a range from near zero resistance to near infinite resistance, metal fuses are often not preferred for us on integrated circuits due to their large size and their difficulty in programming. For example, metal fuses are difficult to laser trim due to the thickness of the metal lines. Laser energy sufficient to trim ("program") a metal fuse can often cause substrate damage.

As a result of using less-than-ideal programmable resistors, the trim circuits 12 of the prior art consume a considerable amount of current. This is because the trim signals at points A and B should swing all the way between about ground and between about $V_{cc}$ such that subsequent logic, such as the decoder 32, are presented with proper logical states and with minimal crowbar current. When a resistive element 26 is in its programmed (i.e. high resistance) state, at least 10 μA must flow through the trimmer 20 or 22 to provide a full ground-to-$V_{cc}$ swing. Lower current levels will not assure this full swing, which is bad for digital logic attempting to process the trim signals. Since each of the trimmers 20 and 22 can consume 10 microamperes of current, a total of 20 microamperes may be required to operate the trim circuit 12. This amount of current can equal the total amount of current required for the remainder of the integrated circuit chip, which is clearly an undesirable situation.

SUMMARY OF THE INVENTION

In recognition of the aforementioned problems with prior art trim circuits, the present invention provides a low power trim circuit for integrated circuits. While a single trimmer of the prior art may require 10 μA of current, a trimmer made in the accordance with the present invention may require only 10 nanoamps (nA), i.e. a thousand fold decrease in current requirements.

A low power trim circuit in accordance of the present invention includes a resistive element that is programmable between a low resistance level and a high resistance level. The low resistance level is appreciably greater than zero resistance, and the high resistance level is appreciably less than infinite resistance. Typically, at least two orders of magnitude separate the two resistance levels. A pair of transistors are coupled in series with the resistive element between $V_{cc}$ and ground. The transistor device that is directly coupled to the resistive element is of and appreciably greater size (e.g. twice as large) as the other transistor. When the resistive element is in the lower resistance state the transistor to which it is coupled dominates a node between the two transistors due to its larger size, causing the node to develop a first logical state. If the resistance element is in a high resistance state, the other (smaller) transistor dominates the node, causing the node to develop the opposite logical state. The low power trim circuit of the present invention consumes very little power because the gain of the transistor coupled to the resistive element is used to achieve the desired rail-to-rail swing of the output.

A low power trim system includes a power supply, a bias generator, at least one trim circuit as described above, and a resistive network responsive to a trim signal developed by the trim circuit. The trim circuit includes a resistive element having a first node coupled to a first voltage level of the power supply, a first transistor having a first active node coupled to a second node of the resistive element, and a first control node coupled to a first biasing voltage created by the bias generator circuit, and a second transistor having a first active node coupled to a second active node of the first transistor, a second active node coupled to a second voltage level of the power supply, and a second control node coupled to a second biasing voltage of the bias generator circuit. The second transistor is smaller than the first transistor such that the first transistor and the second transistor form an unbalanced transistor pair which develops a trim signal between the first transistor and second transistor in response to a programmed resistance of the resistive element.

A method for trimming a circuit in accordance with the present invention includes the steps of: a) measuring at least one resistive parameter of a resistive network in an integrated circuit that is responsive to a trim signal; b) comparing the resistive parameter to a desired resistive parameter and determining a trim resistor programming pattern; and c) programming at least one trim resistor in the integrated circuit in accordance with the trim resistor programming pattern such that flowing a current through a series connection of the trim resistor and an unbalanced transistor pair of said integrated circuit develops a trim signal at a juncture between the unbalanced transistor pair. The trim signal is coupled to the resistive network to trim the resistive parameter.

A method for making an integrated circuit includes the steps of forming a series connection of a resistor, a first transistor, and a second transistor between a voltage potential, where the first transistor is larger than the second transistor such that it controls the node between the first transistor and the second transistor when the resistor is in a low resistance state, and such that the second transistor controls the node when the resistor is in a high resistance state.

As it is apparent from the foregoing, a circuit, system, and method are provided by the present invention which provides trim circuit capabilities with extremely low power consumption. As a result, trim circuits can be used in integrated circuits where they were previously omitted due to power requirements. Furthermore, multiple trim circuits can be used to increase the accuracy of the trimming process where previously the use of such multiple trim circuits would of been impractical due to power consumption requirements.

These and other advantages of the present invention will become apparent to those skilled in the art upon a reading of the following descriptions of the invention and a study of the several figures of the drawing.

DETAILED DESCRIPTION OF THE PREFERRED EMBODIMENTS

Figure 1:
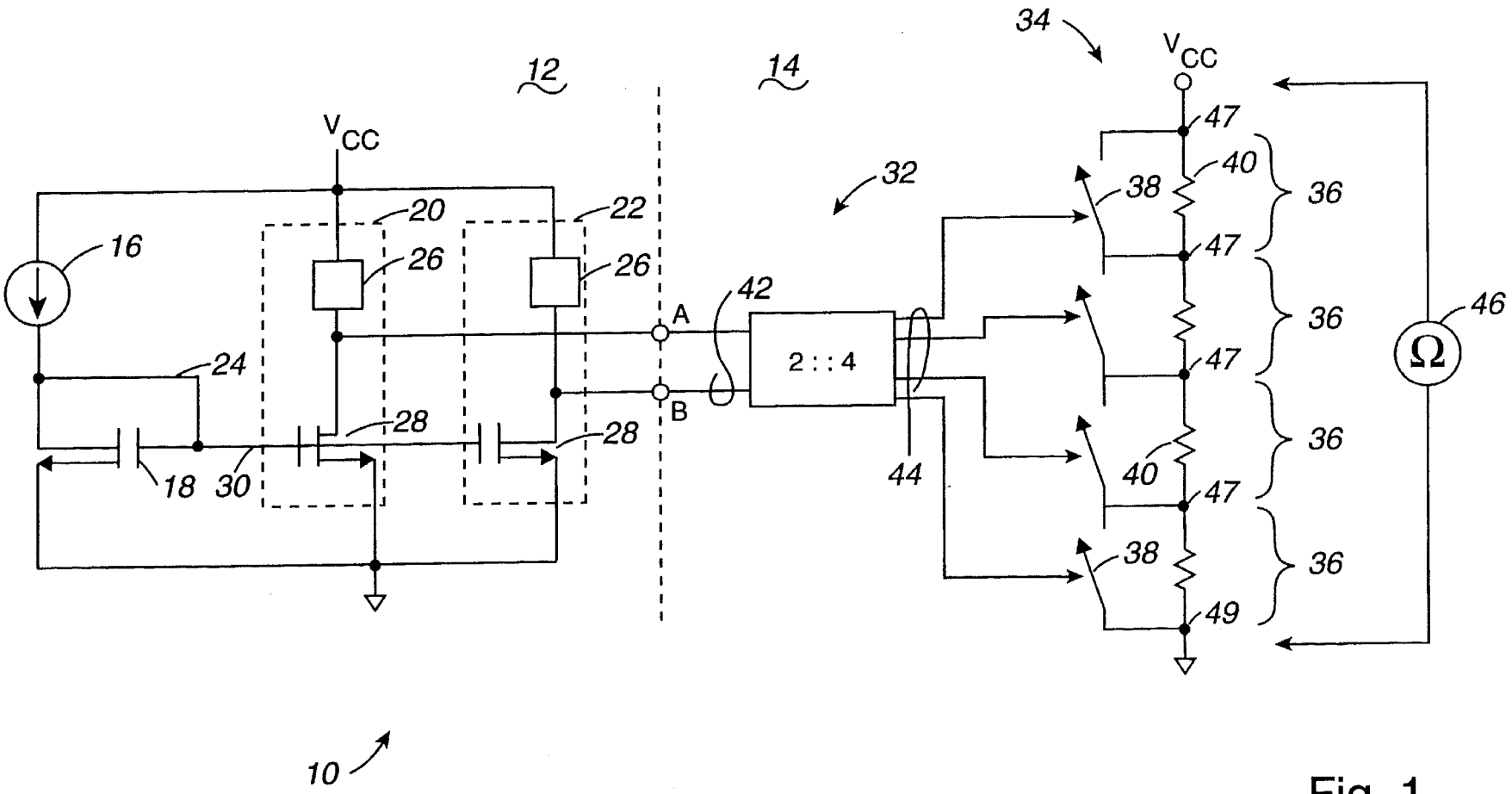
Fig. 1 PRIOR ART
FIG. 1 is a schematic diagram of a prior art trim system 10 where a trim circuit 12 is used to control resistive parameters of a resistive network 14.
Figure 2A:
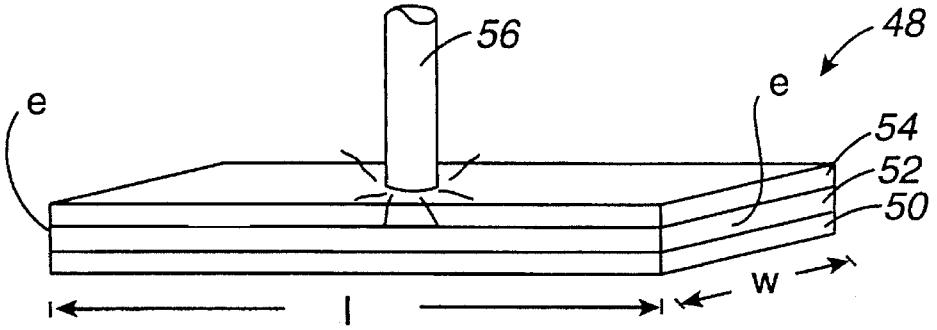
Fig. 2a PRIOR ART
FIGS. 2*a*, 2*b*, and 2*c* illustrates three different programmable resistive elements known in the prior art.
Figure 2B:
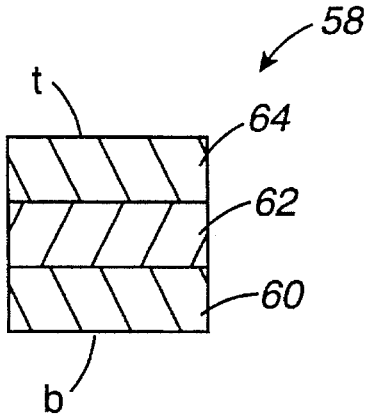
Fig. 2b PRIOR ART
Figure 2C:
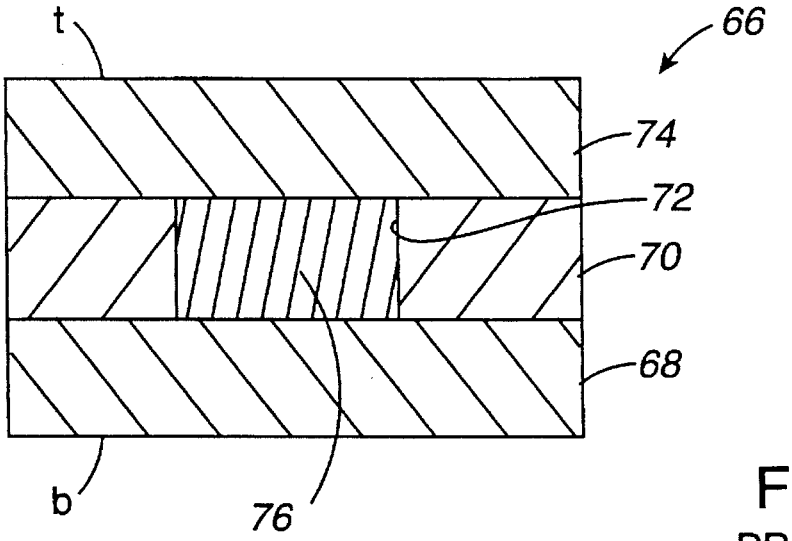
Fig. 2c PRIOR ART
Figure 3:
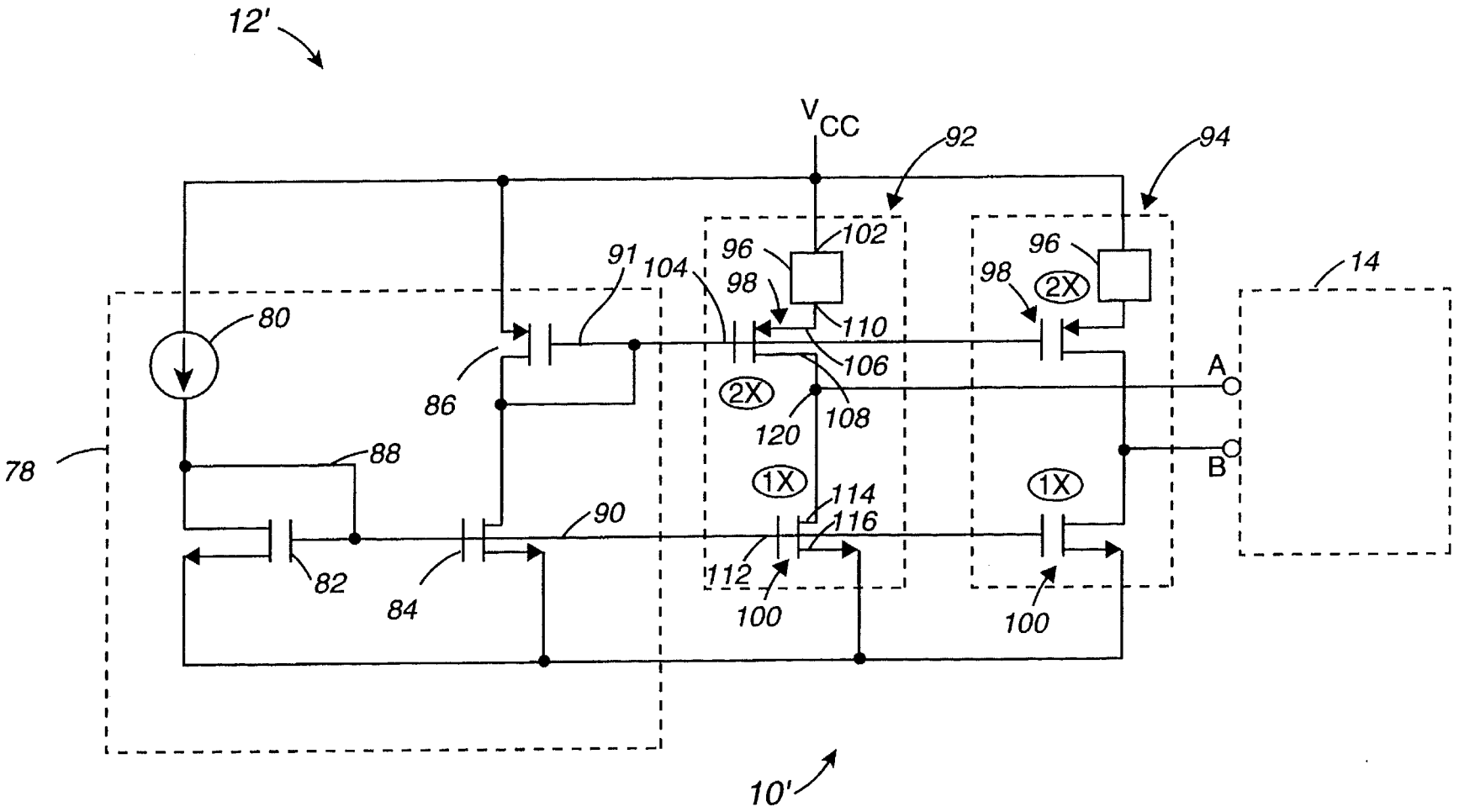
FIG. 3 is a schematic diagram of an improved, low power trim circuit and system in accordance with the present invention.

FIGS. 1 and 2*a*–2*c* were described with reference to the prior art. In FIG. 3, a trim circuit 12' of the present invention is shown in schematic form. It should be noted that the trim circuit 12' can replace the prior art trim circuit 12 of FIG. 1 (as implied by the resistive network 14 shown in broken lines in FIG. 3) to create a trim system 10' in accordance with the present invention. Also, it should be noted that the resistive elements of the trim circuit 12' can be of any suitable type including those illustrated and described with reference to FIGS. 2*a*, 2*b*, and 2*c*. However, in the present preferred embodiment, the resistive elements of trim circuit 12' are preferably the oxide/silicide sandwich structures illustrated in FIG. 2*a*.

In FIG. 3, trim circuit 12' includes a biasing circuit 78 including a current source 80, an n-channel MOSFET 82, an n-channel MOSFET 84, and a p-channel MOSFET 86. The drain and gate of MOSFET 82 are coupled together by a conductor 88 such that MOSFET 82 and MOSFET 84 form a "current mirror." P-channel MOSFET 86 has its drain and source coupled together such that it forms one half of a current mirror pair, as will be discussed subsequently.

In the present invention, the trim circuit 12' includes two trimmer stages or "trimmers" 92 and 94. It should be understood that the trim circuit 12' can include any arbitrary number of pair trimmers, i.e. the number of trimmers can be 1, 2, 3, etc. Of course, if only one trimmer is used, a decoder (such as decoder 32 of FIG. 1 ) is not needed. Two trimmers are discussed herein by way of example. The biasing circuit 78, which produces a first biasing voltage on conductor 91 and a second biasing voltage on conductor 90, is designed to provide one or more trimmers with appropriate biasing voltages.

As noted, each of trimmers 92 and 94 include a resistive element 96, a first transistor 98, and a second transistor 100 coupled, in series, between $V_{cc}$ and ground. The voltage potential between $V_{cc}$ and ground is provided by a power supply (not shown) and is typically in the order of 3–5 volts dc. As noted previously, the resistive elements 96 are preferably oxide/silicide sandwiches as illustrated in FIG. 2*a* and are preferably programmed by a laser beam as previously described.

More particularly, the resistive element 96 has a first node 102 coupled to a first voltage level, $V_{cc}$. The first transistor device has a control node (gate) 104, a first active node (source) 106, and a second active node (drain) 108. The first active node 106 of transistor 98 is coupled to a second node 110 of the resistive element. Again, the nodes 102 and 110 of the resistive element 96 are, preferably, the ends e of the resistive element 48 of FIG. 2*a*. The control node or gate of transistor 98 is coupled to conductive line 91 such that transistors 86 and 98 form a current mirror, creating the first biasing voltage on conductive line 91.

The second transistor 100 includes a control node (gate) 112, a first active node (drain) 114, and a second active node (source) 116. The first active node 114 of transistor 100 is coupled to the second active node 108 of the transistor 98. The second active node 116 is coupled to ground. The control node 112 is coupled to conductive line 90 to create a biasing voltage on the gate of transistor 100.

An important aspect of the present invention is that the transistor that is coupled to the resistive element is substantially larger than the other transistor of the trimmer. If the resistive element 96 is in a low resistance state, e.g. 1–2 kΩ, the relatively larger size of the transistor 98 will cause it to take control of a node 120 between the two transistors. This will cause the trim signal A to swing strongly to $V_{cc}$. If, however, if the resistive element 96 is in a high resistance state, e.g. at 1 MΩ or above, the transistor 98 will be effectively shut off, allowing the smaller transistor 100 to control the node 120, causing the trim signal A to swing strongly to ground. The trimmer 94 operates in the same fashion.

The low power trim circuit of the present invention consumes very little power because the gain of transistor 98 coupled to the resistive element 96 is used to achieve the desired rail-to-rail swing of the output at node A. More particularly, the small voltage change at node 110 caused by trimming resistor 96 is amplified by transistor 98. Typically a change of 100 mV at node 110 will be sufficient to cause node 120 to swing rail-to-rail.

In order for the present circuit to operate properly, the first transistor must be substantially larger than the second transistor. In MOSFET technology, size is typically achieved by varying the channel width. While it is desirable to make the first transistor considerably larger than the second transistor to ensure its dominance over the node when the resistive element is in a low resistance state, this desire must be balanced by the fact that if the first transistor is made too large, it will still dominate the node even after the resistor is trimmed to its high-resistance state. It is therefore been found that if the first transistor is in the range of 1.5–2.5 times the size of the second transistor and, preferably, is about twice the size of the second transistor, that a controllable first transistor is produced that can clearly dominate the node between the two transistors when the resistors are in a low resistance state.

As noted previously, a number of technologies can be used for the resistive element. It has been implied and is now herein explicitly stated that multiple technologies can also be used for the transistor devices. In the current example, MOSFET transistors are described having a gate as the control node and sources and drains as the active nodes. However, the circuit illustrated in FIG. 3 is completely transferable to bipolar technologies wherein PNP transistors are substituted for p-channel MOSFET transistors, and NPN transistors are substituted for n-channel MOSFET transistors. In the bipolar embodiment of the present invention, the control node is the base, and the emitter and collector are the active nodes of the transistor. In other words, the MOSFET gate corresponds to a bipolar base, the MOSFET source corresponds to a bipolar emitter, and the MOSFET drain corresponds to a bipolar collector. In bipolar technology, the first transistor is made bigger than the second transistor by making the emitter of the first transistor bigger (i.e. a greater area) than the emitter of the second transistor.

As will be apparent to those skilled in the art, the resistive element can be coupled to either $V_{cc}$ (as shown in FIG. 3) or it can be coupled to ground, i.e. the voltage level to which it is coupled is selectable by the circuit designer. For example, an alternate embodiment of the present invention has the resistive element 96 coupled between node 116 and ground, and transistor 100 is made larger than transistor 98. In this alternate embodiment, however, the trim signal A is inverted in polarity, i.e. the trim signal A is low when the resistive element 96 has a low resistance level, and the trim signal A is high when the trim resistor 96 has a high resistance level.

The trim circuit and method of the present invention can, and typically do, form a part of a larger system and/or process. For example, once the integrated circuit has been trimmed, it is typically packaged and then made a part of a larger system by attaching it to a printed circuit (PC) board and adding other electronic devices, power supplies, etc. It should therefore be understood for the product that results from the processes of the present invention include the trimmer itself, integrated circuit chips including one or more trimmers, larger systems (e.g. PC board level systems including one or more integrated circuit chips having one or more trimmers), and products which include such larger systems.

While this invention has been described in terms of several preferred embodiments, it is contemplated that alternatives, modifications, permutations and equivalents thereof will become apparent to those skilled in the art upon a reading of the specification and study of the drawings. It is therefore intended that the following appended claims include all such alternatives, modifications, permutations and equivalents as fall within the true spirit and scope of the present invention.

What is claimed is:

1. A low power trim circuit comprising:

a resistive element having a first node and a second node, said resistive element having a resistance between said first node and said second node that is permanently programmable to one of a low resistance level and a high resistance level that is higher than said low resistance level, wherein said first node is to be coupled to a first voltage level;

a first transistor having a control node, a first active node, and a second active node, wherein a control signal applied to said control node of said first transistor can control a flow of current through said first transistor between said first active node and said second active node, wherein said first active node is coupled to said second node of said resistive element, said first transistor having a first size corresponding to a first current level for a given control signal applied to said control node; and a second transistor having a control node, a first active node, and a second active node, wherein a control signal applied to said control node of said second transistor can control a flow of current through said second transistor between said first active node and said second active node, wherein said first active node of said second transistor is coupled to said second node of said first transistor and wherein said second active node of said second transistor is to be coupled to a second voltage level, said second transistor having a second size corresponding to a second current level for said given control signal, wherein said second size is less than said first size;

whereby a trim signal voltage can be developed between said first transistor and said second transistor in response to a programmed resistance of said resistive element.

2. A low power trim circuit as recited in claim 1 wherein said resistive element is selected from the group consisting essentially of silicide resistors, capacitors having intrinsic resistances, and anti-fuses having intrinsic resistances.

3. A low power trim circuit as recited in claim 1 wherein said first transistor and said second transistor are of opposite polarity types.

4. A low power trim circuit as recited in claim 3 wherein said first transistor and said second transistor are of the same technology type, wherein said technology type is selected from the group consisting essentially of MOSFET technologies and bipolar technologies.

5. A low power trim circuit as recited in claim 4 wherein said first transistor is a MOSFET of a first channel type and said second transistor is a MOSFET of a second channel type.

6. A low power trim circuit as recited in claim 5 wherein said first transistor is made larger than said second transistor by providing a channel width in said first transistor that is wider than a channel width of said second transistor.

7. A low power trim circuit as recited in claim 6 wherein said channel width of said first transistor is at least 1.5 times the channel width of said second transistor.

8. A low power trim circuit as recited in claim 7 wherein said channel width of said first transistor is about 2 times the channel width of said second transistor.

9. A low power trim circuit as recited in claim 5 wherein said first channel type is a p-channel type, said second channel type is a n-type channel, said first voltage level is at a level of about Vcc, and said second voltage level is at a level of about ground.

10. A low power trim system comprising:

a power supply providing at least a first voltage level and a second voltage level;

a bias generator circuit coupled to said power supply for developing a first biasing voltage and a second biasing voltage;

at least one trim circuit coupled to said power supply and said bias generator circuit, said at least one trim circuit developing at least one trim signal output, said at least one trim circuit comprising:

(a) a programmable resistive element having a first node coupled to said first voltage level;

(b) a first transistor having a first active node coupled to a second node of said resistive element and a first control node coupled to said first biasing voltage; and (c) a second transistor having a first active node coupled to a second active node of said first transistor, a second active node coupled to said second voltage level, and a second control node coupled to said second biasing voltage, said second transistor being smaller than said first transistor such that said first transistor and said second transistor form an unbalanced transistor pair such that a trim signal is developed between said first transistor and said second transistor in response to a programmed resistance of said resistive element; and a resistive network responsive to said trim signal such that resistive parameters of said resistive network may be varied by said trim signal.

11. A low power trim system as recited in claim 10 wherein said first voltage level is at a level of about Vcc, and wherein said second voltage level is at a level of about ground.

12. A low power trim system as recited in claim 10 wherein said bias generator circuit includes a first current mirror transistor which, in conjunction with said first transistor, comprise a first current mirror to provide said first biasing voltage for said first transistor, and a second current mirror transistor which, in conjunction with said second transistor, comprise a second current mirror to provide said second biasing voltage for said second transistor.

13. A low power trim system as recited in claim 10 wherein said resistive element is selected from the group consisting essentially of silicide resistors, capacitors having intrinsic resistances, and anti-fuses having intrinsic resistances.

14. A low power trim system as recited in claim 10 wherein said first and second transistors are selected from the group consisting essentially of MOSFET transistors and bipolar transistors.

15. A low power trim system as recited in claim 10 wherein the size ratio between said first transistor and said second transistor is in the range of 1.5:1 and 2.5:1.

16. A low power trim system as recited in claim 15 wherein the size ratio between said first transistor and said second transistor is about 2:1.

17. A low power trim system as recited in claim 10 wherein said resistive network is provided with at least one switch in parallel with at least one resistor, said switch being responsive to said trim signal.

18. A low power trim system as recited in claim 10 wherein a plurality of trim circuits are provided to provide a multi-value trim signal, and wherein said resistive network is provided with a plurality of resistors coupled to a plurality of switches, said plurality of switches being responsive to said multi-value trim signal.

19. A low power trim system as recited in claim 18 wherein said plurality of switches are coupled to said plurality of resistors such that a plurality of parallel switch/resistor pairs are provided, said parallel switch/resistor pairs being coupled in series between said first voltage level and said second voltage level.

20. A low power trim system as recited in claim 19 wherein said resistive network further includes a decoder coupled between said multi-valued trim signal and said plurality of switch/resistor pairs.

21. A method for trimming a circuit comprising the steps of:

measuring with a resistance measuring apparatus at least one resistive parameter in ohms of a resistive network in an integrated circuit that is responsive to a trim signal;

comparing said resistive parameter to a desired resistive parameter and determining a trim resistor programming pattern;

programming at least one trim resistor in said integrated circuit in accordance with said trim resistor programming pattern such that flowing a current through a series connection of said trim resistor and an unbalanced transistor pair of said integrated circuit develops a trim signal at a juncture between said unbalanced transistor pair, said trim signal being coupled to said resistive network to trim said resistive parameter, said unbalanced transistor pair including a first transistor of a first size and a second transistor of a second size different from said first size.

22. A method for trimming a circuit as recited in claim 21 further comprising the steps of:

creating an electronic apparatus utilizing said integrated circuit.

23. A method for trimming a circuit as recited in claim 22 wherein said step of creating an electronic apparatus comprising the steps of:

creating a printed circuit board; and coupling said integrated circuit and other electronic devices to said printed circuit board.

24. A method for making an integrated circuit comprising:

forming a series connection of a permanently programmable resistor device, a first transistor, and a second transistor between voltage potential nodes on a semiconductor substrate, such that said resistor device and said first transistor are directly coupled together at a first node and such that said first transistor and said second transistor are directly coupled together at a second node, where a first size of said first transistor is larger than a second size of said second transistor such that it controls said second node between said first transistor and said second transistor if said resistor device is in a low-resistance state, and such that said second transistor controls said second node if said resistor device is in a high-resistance state.

25. A method for making an integrated circuit as recited in claim 24 wherein further comprising the step of permanently programming said resistor into one of said low-resistance state and said high-resistance state.

* * * * *